US009760051B2

(12) United States Patent
Hashimoto

(10) Patent No.: US 9,760,051 B2
(45) Date of Patent: Sep. 12, 2017

(54) POST-PROCESSING APPARATUS AND IMAGE FORMING SYSTEM

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Yoshihisa Hashimoto, Gotenba Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 9 days.

(21) Appl. No.: 15/006,342

(22) Filed: Jan. 26, 2016

(65) Prior Publication Data

US 2017/0212462 A1 Jul. 27, 2017

(51) Int. Cl.

| | |
|---|---|
| ***B65H 31/24*** | (2006.01) |
| ***B65H 39/11*** | (2006.01) |
| ***B65H 29/60*** | (2006.01) |
| ***G03G 15/00*** | (2006.01) |
| ***B65H 29/12*** | (2006.01) |
| ***B65H 43/04*** | (2006.01) |
| ***B65H 37/04*** | (2006.01) |
| ***G03G 21/16*** | (2006.01) |

(52) U.S. Cl.

CPC ..... *G03G 15/6529* (2013.01); *B65H 29/125* (2013.01); *B65H 31/24* (2013.01); *B65H 37/04* (2013.01); *B65H 39/11* (2013.01); *B65H 43/04* (2013.01); *G03G 15/5012* (2013.01); *G03G 15/70* (2013.01); *G03G 21/1638* (2013.01); *B65H 2511/528* (2013.01); *B65H 2601/11* (2013.01); *G03G 2215/00552* (2013.01); *G03G 2221/1675* (2013.01)

(58) Field of Classification Search

CPC ..... B65H 2511/528; B65H 2513/42; B65H 2601/11; B65H 29/60; B65H 29/62; B65H 31/24; B65H 39/11; B65H 37/04; G03G 15/70; G03G 15/5012; G03G 21/1675; G03G 2215/00552

See application file for complete search history.

(56) References Cited

U.S. PATENT DOCUMENTS 6,205,297 B1 3/2001 Tachibana et al.
6,449,440 B1 * 9/2002 Sawada ..... G03G 15/5012 399/19

(Continued)

*Primary Examiner* — Luis A Gonzalez

(74) *Attorney, Agent, or Firm* — Amin, Turocy & Watson LLP

(57) ABSTRACT

A post-processing apparatus of an embodiment includes a first tray configured to receive a sheet on which the post processing is not executed by a processing section, a second tray configured to temporarily place a sheet, an inlet roller configured to carry in a sheet discharged from an image forming apparatus into the post-processing apparatus, a first roller configured to convey the sheet to the first tray, a second roller configured to convey the sheet to the second tray, a detection sensor configured to detect whether or not there is sheet being conveyed in a sheet conveyance path from the inlet roller to the first or the second tray, and a roller control section configured to drive the first or the second roller if an image forming apparatus stops the discharge of the sheet that is being printed and the detection sensor detects the sheet.

9 Claims, 8 Drawing Sheets

(56) References Cited

U.S. PATENT DOCUMENTS

| | | | | |
|---|---|---|---|---|
| 7,975,999 | B2 * | 7/2011 | Fukasawa | B65H 37/04 270/32 |
| 8,191,888 | B2 | 6/2012 | Matsumoto et al. | |
| 8,210,514 | B1 * | 7/2012 | Kato | B65H 7/10 270/58.07 |
| 8,979,089 | B2 * | 3/2015 | Mano | B65H 29/14 270/58.07 |
| 2010/0194026 | A1 | 8/2010 | Iguchi | |
| 2014/0241737 | A1 * | 8/2014 | Shirasaka | G03G 15/6552 399/20 |
| 2015/0168907 | A1 * | 6/2015 | Nishi | G03G 15/70 399/21 |
| 2016/0154364 | A1 * | 6/2016 | Kamata | G03G 15/70 399/21 |

* cited by examiner

POST-PROCESSING APPARATUS AND IMAGE FORMING SYSTEM

FIELD

Embodiments described herein relate generally to a post-processing apparatus and an image forming system.

BACKGROUND

A post-processing apparatus is used widely that carries out a post processing on a sheet on which an image is formed by an image forming apparatus. The post processing carried out by the post-processing apparatus includes, for example, a process of sorting sheets, a process of punching a hole on a sheet and a process of stapling a bunch of piled sheets. Operating speeds of the image forming apparatus and the post-processing apparatus are both improved, and thus less time is spent in forming an image and processing a sheet to improve the convenience. On the other hand, in the image forming apparatus or the post-processing apparatus, if a sheet jams, a user has to remove the jammed sheet and a sheet being processed, which is troublesome.

DETAILED DESCRIPTION

Figure 1:
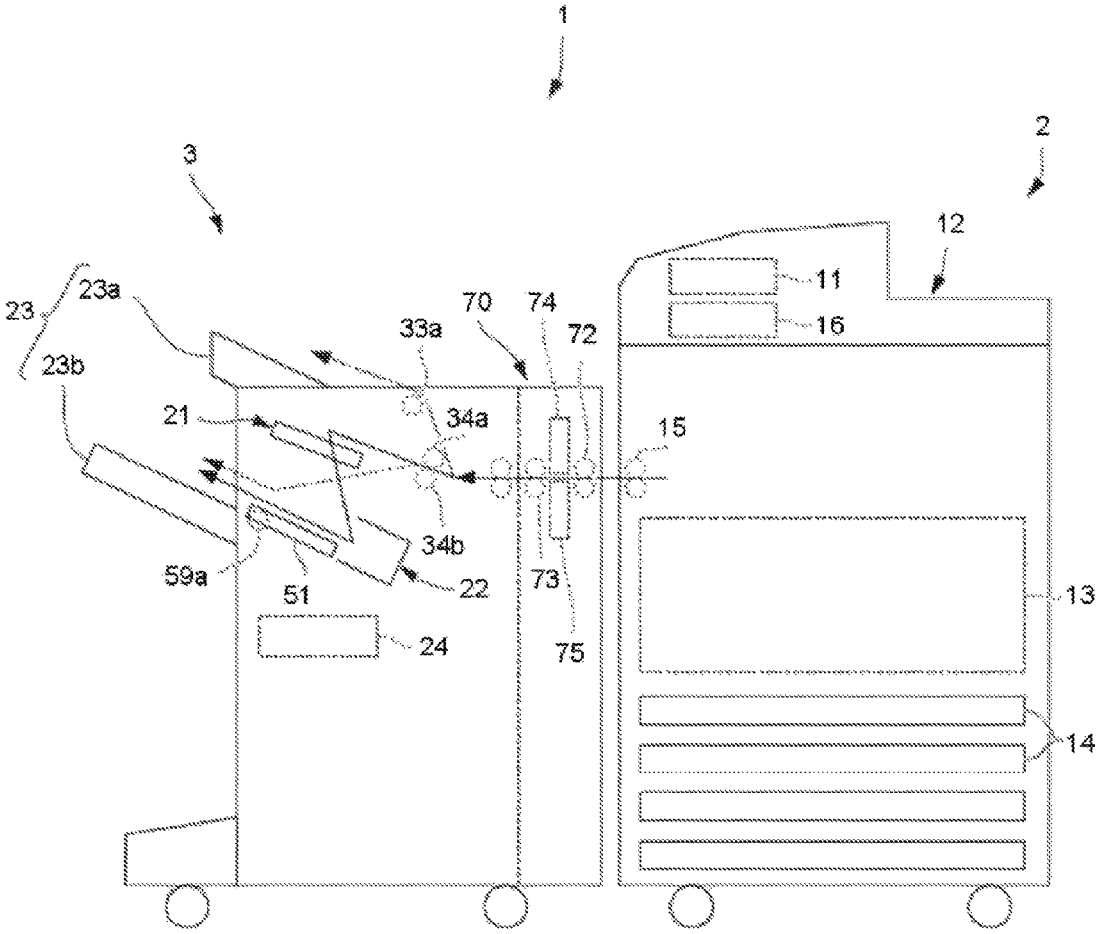
FIG. 1 is a front view exemplifying the structure of an image forming system according to an embodiment.

A post-processing apparatus of an embodiment comprises a processing section, a first tray, a second tray, an inlet roller, a first roller, a second roller, a detection sensor and a roller control section. The processing section executes post processing on a sheet. The first tray receives a sheet on which the post processing is not executed by the processing section. The second tray temporarily places a sheet in the post-processing apparatus. The inlet roller carries in a sheet discharged from an image forming apparatus into the post-processing apparatus. The first roller conveys the sheet carried in by the inlet roller to the first tray. The second roller conveys the sheet carried in by the inlet roller to the second tray. The detection sensor detects whether or not there is a sheet being conveyed in a sheet conveyance path from the inlet roller to the first or the second tray. The roller control section drives the first or the second roller in a case in which the image forming apparatus stops the discharge of the sheet that is being printed and the detection sensor detects the sheet.

The post-processing apparatus and an image forming system of an exemplary embodiment are described hereinafter with reference to the accompanying drawings. The same components are applied with the same reference numerals in each figure and are not described repeatedly.

Figure 2:
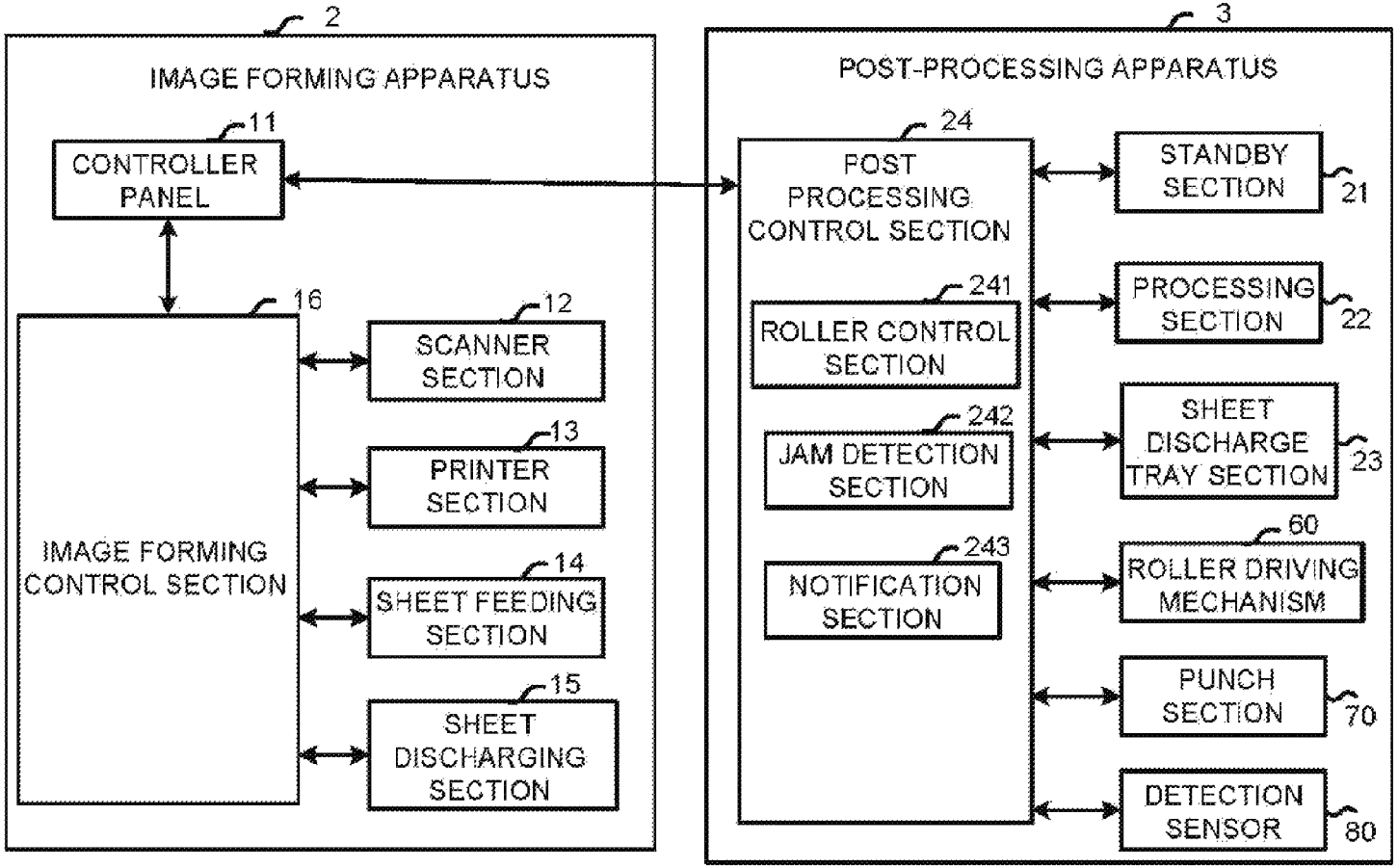
FIG. 2 is a block diagram exemplifying the structure of the image forming system.

FIG. 1 and FIG. 2 are diagrams exemplifying the structure of an image forming system 1 of an embodiment. The image forming system 1 is provided with an image forming apparatus 2 and a post-processing apparatus 3. The image forming apparatus 2 forms an image on a sheet-like medium such as a paper or a film. Hereinafter, the sheet-like medium is called a sheet. The image forming apparatus 2 discharges the sheet on which the image is formed. The image forming apparatus 2 comprises a controller panel 11, a scanner section 12, a printer section 13, a sheet feeding section 14, a sheet discharging section 15 and an image forming control section 16.

The controller panel 11 is equipped with a plurality of keys for receiving operations of a user. The controller panel 11 receives an input relating to a post processing carried out on the sheet on which the image is formed, for example, the controller panel 11 receives a selection of a sort mode, a stapling mode or a non-sort mode. The sort mode refers to that sheets are sorted and output. The stapling mode refers to that sheets are bundled and then stapled. The non-sort mode refers to that sheets are neither sorted nor stapled. In a case in which the non-sort mode is selected, the controller panel 11 receives a selection about the discharge of the sheet to which one of a fixed tray 23*a* and a movable tray 23*b*. The image forming apparatus 2 sends information relating to a post processing, that is, information received by the controller panel 11 to the post-processing apparatus 3. The fixed tray 23*a* receives a sheet on which a post processing is not executed. The movable tray 23*b* receives both a sheet on which a post processing is not executed and a sheet on which a post processing is executed.

The scanner section 12 includes a reading section for reading an image to be copied. The scanner section 12 sends image information indicating the image obtained by the reading section to the printer section 13.

The printer section 13 forms an output image according to the image information acquired by the scanner section 12 or an external device (for example, a client PC). The printer section 13 makes the formed output image fixed on a sheet. For example, the image is fixed by heating and pressuring the sheet after a toner image serving as the output image formed by a developing agent such as a toner is transferred on the sheet.

The sheet feeding section 14 supplies sheets one by one to the printer section 13 in accordance with a timing when the printer section 13 forms the output image. The sheet discharging section 15 conveys the sheet on which the output image is fixed from the printer section 13 to the post-processing apparatus 3.

The image forming control section 16 is programmed to control operations of the image forming apparatus 2. The image forming control section 16 controls the controller panel 11, the scanner section 12, the printer section 13, the sheet feeding section 14 and the sheet discharging section 15. The image forming control section 16 may comprise, for example, a CPU, a ROM and a RAM. The CPU executes a control processing by reading out a program recorded in a non-transitory recording medium such as the ROM and executing the program.

The post-processing apparatus 3 is an example of "a sheet post-processing apparatus". The post-processing apparatus 3 which is arranged adjacently to the image forming apparatus 2 is communicably connected with the image forming apparatus 2. The post-processing apparatus 3 is equipped with a standby section 21, a processing section 22, a sheet discharge tray section 23, a post processing control section 24, a roller driving mechanism 60, a punch section 70 and a detection sensor 80.

The standby section 21 temporarily buffers the sheet conveyed by the image forming apparatus 2. For example, the standby section 21 waits for one or a plurality of succeeding sheets during a period when a post processing is being executed on the former sheet by the processing section 22. If the processing section 22 is idle, the standby section 21 drops the sheet that is being buffered towards the processing section 22.

The processing section 22 carries out a post processing on the sheet. The post processing contains a processing of sorting a sheet, a processing of aligning sheets and a processing of bundling and stapling sheets. The processing section 22 carries out a stapling processing of bundling and stapling many sheets that are aligned. The processing section 22 conveys the sheet on which the post processing is carried out to the sheet discharge tray section 23.

The sheet discharge tray section 23 includes the fixed tray 23*a* and the movable tray 23*b*. The fixed tray 23*a* is arranged on the upper surface side of the post-processing apparatus 3. The movable tray 23*b* is arranged on a side surface of the post-processing apparatus 3. The side surface on which the movable tray 23*b* is arranged is different from the side surface where the post-processing apparatus 3 is adjacent to the image forming apparatus 2. The movable tray 23*b* can move in a vertical direction along the side surface of the post-processing apparatus 3. A sheet is discharged into the fixed tray 23*a* or the movable tray 23*b* depending on a discharge destination of a sheet selected by the user through the controller panel 11.

The roller driving mechanism 60 drives each roller arranged inside the post-processing apparatus 3 to convey a sheet or carry out a post processing of a sheet. The roller driving mechanism 60 is provided with a driving source for generating a motive power to drive a roller and a transmission section for transmitting the motive power to the roller for each roller.

The punch section 70 carries in the sheet from the image forming apparatus 2 and conveys the carried-in sheet to the post-processing apparatus 3. The punch section 70 punches a hole at a designated position of the sheet in a case in which there is an instruction of the user through the controller panel 11.

The detection sensor 80 contains a plurality of sensors that detects whether or not a sheet exists in the conveyance path for conveying the sheet in the post-processing apparatus 3.

The post processing control section 24 controls the post-processing apparatus 3. The post processing control section 24 controls the standby section 21, the processing section 22, the sheet discharge tray section 23, the roller driving mechanism 60, and the detection sensor 80. The post processing control section 24 contains a roller control section 241, a jam detection section 242 and a notification section 243.

The roller control section 241 controls the roller driving mechanism 60 to drive a roller corresponding to an operation. The jam detection section 242 determines whether or not a sheet jam occurs in the conveyance path of the sheet in the post-processing apparatus 3. The jam detection section 242 specifies an occurrence location of the sheet jam. The notification section 243, in a case in which the sheet is conveyed in the post-processing apparatus 3 when the abnormality occurs, notifies the image forming apparatus 2 of information relating to the conveyance.

The post processing control section 24 may comprise, for example, a CPU, a ROM and a RAM. The CPU executes a control processing by reading out a program stored in a non-transitory recording medium such as the ROM and executing the program. The operations of the roller control section 241, the jam detection section 242 and the notification section 243 are carried out through the execution of the program by the CPU of the post processing control section 24.

In the following description, "upstream side" means the upstream side of conveyance direction of a sheet in the image forming system 1. "Downstream side" means the downstream side of the conveyance direction of the sheet in the image forming system 1.

Figure 3:
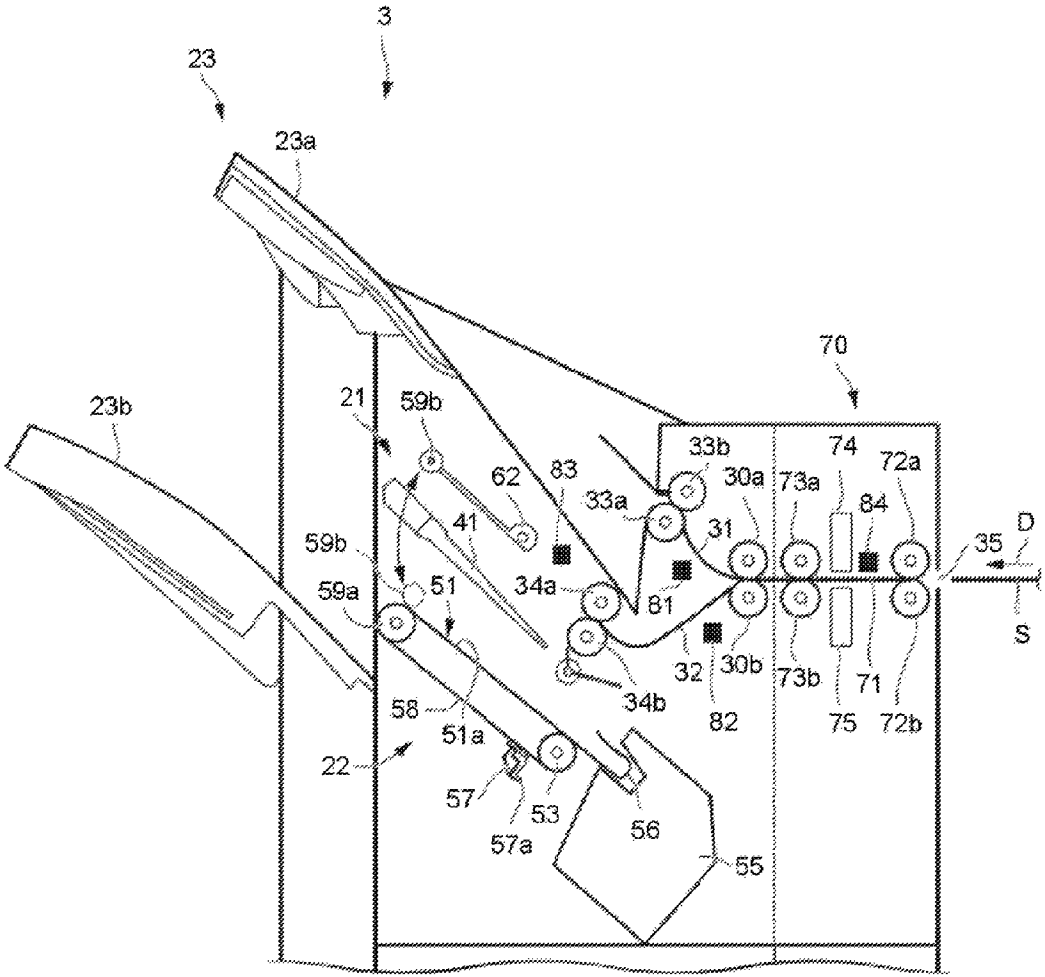
FIG. 3 is a cross-sectional view illustrating a post-processing apparatus.

FIG. 3 is a diagram illustrating a cross-section of the post-processing apparatus 3. The post-processing apparatus 3 is provided with the punch section 70, inlet rollers 30*a* and 30*b*, conveyance paths 31 and 32 of sheet, discharge roller 33*a* and 33*b*, exit roller 34*a* and 34*b*, the standby section 21 and the processing section 22.

The punch section 70 comprises a conveyance path 71 of a sheet, inlet rollers 72*a* and 72*b*, exit rollers 73*a* and 73*b*, a punch blade 74 and a dust box 75. The inlet rollers 72*a* and 72*b* are arranged nearby a sheet supply port 35 of the post-processing apparatus 3. A sheet S is supplied from image forming apparatus 2 to the sheet supply port 35. The inlet rollers 72*a* and 72*b* carry in the sheet supplied to the sheet supply port 35 towards the inside of the punch section 70. The inlet rollers 72*a* and 72*b* convey the carried-in sheet along a conveyance path 71. The conveyance path 71 is arranged between the inlet rollers 72*a* and 72*b* and the exit rollers 73*a* and 73*b*. The conveyance path 71 guides the carried-in sheet towards the inlet roller 30*a*. The punch blade 74 is arranged at the upper side of the conveyance path 71. The punch blade 74 punches a hole on the sheet conveyed by the conveyance path 71 according to the setting selected by the user. The dust box 75 is arranged at a position of the lower side of the conveyance path 71, which corresponds to the position of the punch blade 74. The dust box 75 houses punch scraps generated at the time a hole is punched on the sheet.

The inlet rollers 30*a* and 30*b* are arranged nearby the exit rollers 73*a* and 73*b* of the punch section 70. The inlet rollers 30*a* and 30*b* convey the sheet conveyed from the punch section 70 towards the inside of the post-processing apparatus 3. The conveyance paths 31 and 32 contain a first conveyance path 31 and a second conveyance path 32.

The first conveyance path 31 is arranged between the inlet rollers 30*a* and 30*b* and the fixed tray 23*a* of the sheet discharge tray section 23. The first conveyance path 31 guides the sheet conveyed from the punch section 70 towards the fixed tray 23*a*. The first conveyance path 31 guides the sheet in a case in which the non-sort mode is selected and the fixed tray 23*a* is selected as a discharge destination. The discharge rollers 33*a* and 33*b* are arranged at the downstream side of the first conveyance path 31. The discharge rollers 33*a* and 33*b* discharge the sheet conveyed in the first conveyance path 31 towards the fixed tray 23*a*.

The second conveyance path 32 is arranged between the inlet rollers 30*a* and 30*b* and the exit rollers 34*a* and 34*b* inside the post-processing apparatus 3. The second conveyance path 32 guides the sheet conveyed from the punch section 70 towards the exit rollers 34*a* and 34*b*. The second conveyance path 32 guides the sheet if the sort mode or the staple mode is selected. Further, the second conveyance path 32 guides the sheet if the non-sort mode is selected and the movable tray 23*b* is selected as a discharge destination of the sheet.

The exit rollers 34*a* and 34*b* are arranged at the end portion of the downstream side of the second conveyance path 32. The exit rollers 34*a* and 34*b* convey the sheet conveyed by the second conveyance path 32 towards the standby section 21. The exit rollers 34*a* and 34*b*, in a case in which the movable tray 23*b* is selected as the discharge destination in the non-sort mode, convey the sheet towards a discharge roller 59*a* of the processing section 22.

The standby section 21 includes a standby tray (buffer tray) 41. The end portion of the upstream side of the standby tray 41 is located nearby the exit rollers 34*a* and 34*b*. For example, the end portion of the upstream side of the standby tray 41 is located slightly below the exit of the second conveyance path 32. The standby tray 41 is inclined with respect to the horizontal direction to be gradually raised to advance towards the downstream side of a sheet conveyance direction D. The sheet is sent from the second conveyance path 32 to the standby tray 41. The standby tray 41 waits for the overlap of a plurality of sheets during a period when the processing section 22 carries out the post processing.

The processing section 22 is equipped with a processing tray 51, a vertical alignment roller 53, a stapler 55, an ejector 56, a bunch pawl 57, a bunch pawl belt 58 and discharge rollers 59*a* and 59*b*.

The processing tray 51 is arranged below the standby tray 41. The processing tray 51 is inclined with respect to the horizontal direction to be slowly raised to advance towards the downstream side of the sheet conveyance direction D. The processing tray 51 has a conveyance surface 51*a* for supporting a sheet on which the sheet is placed.

The stapler 55 is arranged at the end portion of the upstream side of the processing tray 51. The stapler 55 carries out a stapling processing for stapling a bunch of plural sheets placed on the processing tray 51 if the staple mode is selected. The ejector 56 is arranged at the end portion of the upstream side of the processing tray 51. The ejector 56 can move towards the downstream side of the sheet conveyance direction D. The ejector 56 transfers a bunch of sheets to which the stapling processing or the sort processing is performed to the bunch pawl 57.

The bunch pawl 57 is installed on the bunch pawl belt 58. The bunch pawl belt 58 is stretched over a driving roller and a driven roller (not shown) of the processing tray 51. The bunch pawl belt 58, the driving roller and the driven roller exemplarily comprise a bunch pawl drive mechanism for driving the bunch pawl 57. The bunch pawl 57 moves in the sheet conveyance direction D and in a direction opposite to the sheet conveyance direction D along with the movement of the bunch pawl belt 58. The bunch pawl 57 discharges a bunch of sheets transferred from the ejector 56 towards the movable tray 23*b* through the cooperation with the discharge roller 59*a*. The bunch pawl 57 includes a projection section 57*a* which projects towards the sheet conveyance direction.

The discharge rollers 59*a* and 59*b* contain a discharge driving roller 59*a* and a discharge pinch roller 59*b*. The discharge driving roller 59*a* is arranged at the end portion of the downstream side of the processing tray 51. The discharge driving roller 59*a* contacts with the sheet guided to the conveyance surface 51*a* of the processing tray 51 from the bottom. The discharge driving roller 59*a* discharges the sheet placed on the processing tray 51 from the processing tray 51 towards the movable tray 23*b*.

The discharge pinch roller 59*b* is arranged above the discharge driving roller 59*a*. The discharge pinch roller 59*b* is a driven roller having no driving source. The discharge pinch roller 59*b* can move between a standby position that locates above the standby tray 41 and a rotational position facing the discharge driving roller 59*a*. The discharge pinch roller 59*b* is driven by a pinch roller drive mechanism to move between the standby position and the rotational position. The discharge pinch roller 59*b* moves to the rotational position to make the sheet sandwiched between the discharge driving roller 59*a* and the discharge pinch roller 59*b*. In this way, the rotation of the discharge driving roller 59*a* can be stably transmitted to the sheet.

The detection sensor 80 contains a first detection sensor 81, a second detection sensor 82, a third detection sensor 83 and a fourth detection sensor 84. The first detection sensor 81 is arranged along the first conveyance path 31. The first detection sensor 81 detects whether or not there is a sheet in the first conveyance path 31. The second detection sensor 82 is arranged along the second conveyance path 32. The second detection sensor 82 detects whether or not there is a sheet in the second conveyance path 32. The third detection sensor 83 is arranged nearby the exit rollers 34*a* and 34*b* and the standby tray 41. The third detection sensor 83 detects whether or not there is a sheet between a position from the exit rollers 34*a* and 34*b* to the standby tray 41. The fourth detection sensor 84 is arranged along the conveyance path 71 of the punch section 70. The fourth detection sensor 84 detects whether or not there is a sheet in the punch section 70.

Figure 4:
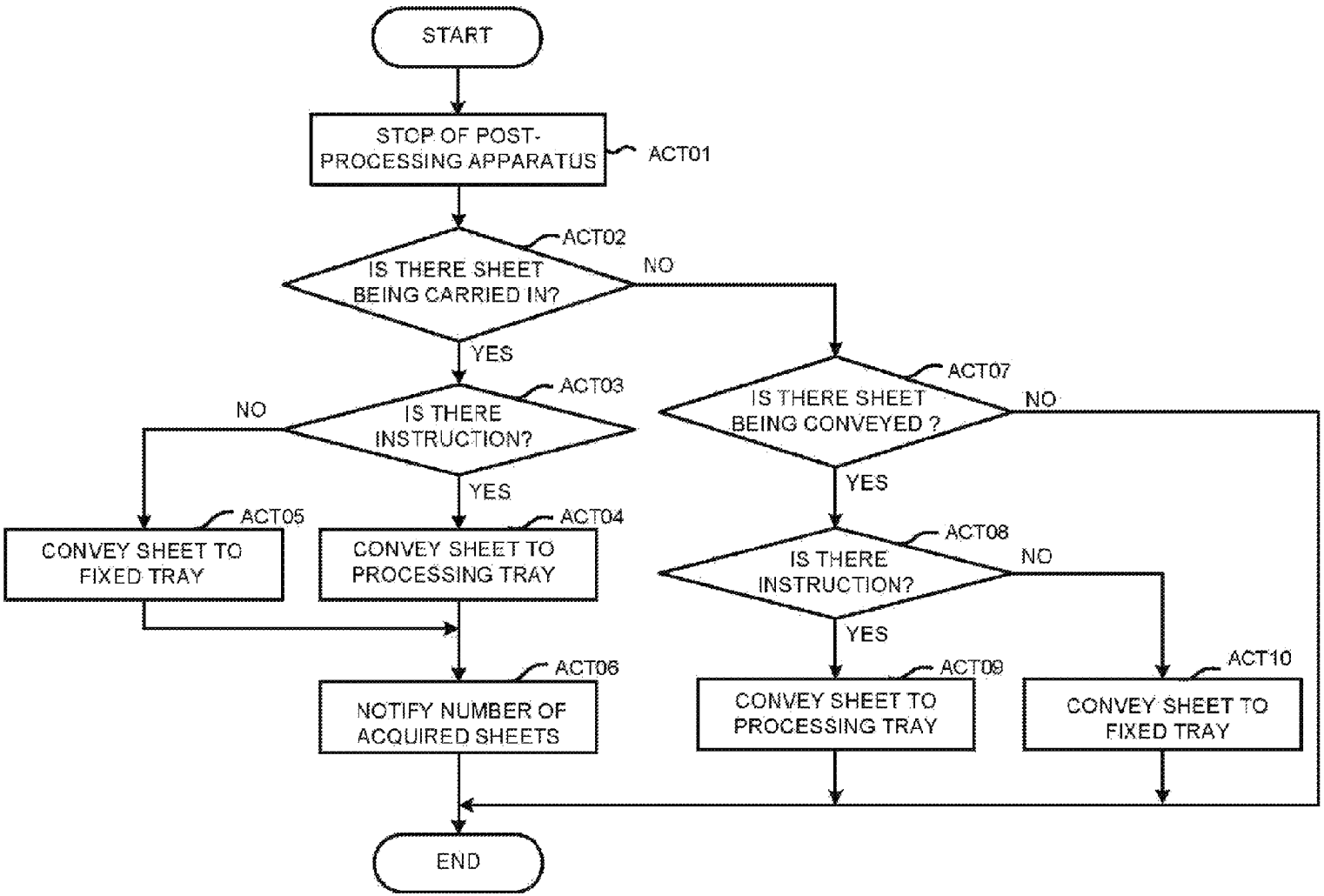
FIG. 4 is a first flowchart illustrating a sheet conveyance operation carried out by the post-processing apparatus at a time of occurrence of an abnormality.
Figure 5:
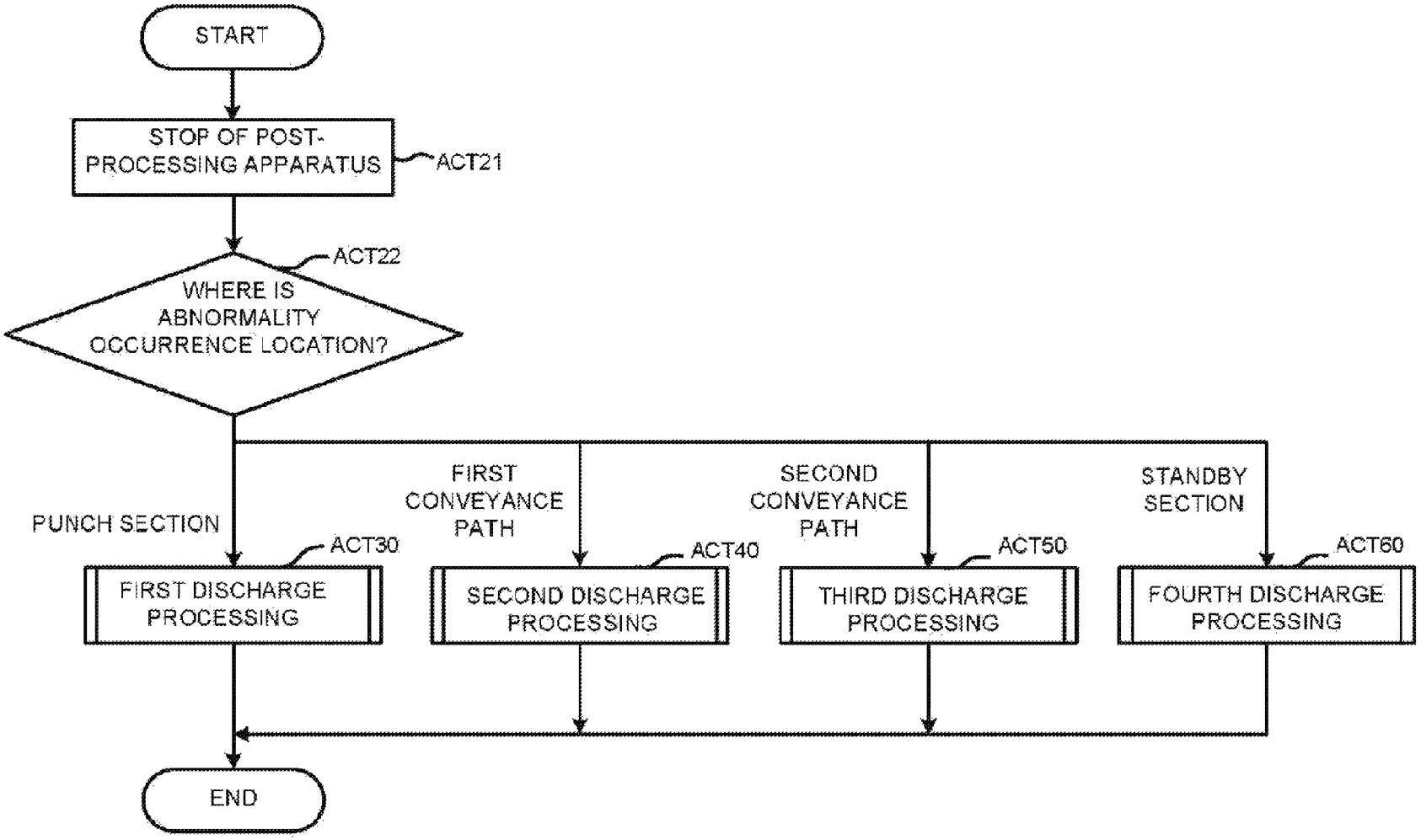
FIG. 5 is a second flowchart illustrating a sheet conveyance operation carried out by the post-processing apparatus at a time of occurrence of an abnormality.

Hereinafter, operations of conveying a sheet by the post-processing apparatus 3 are described with reference to FIG. 4-FIG. 9 when abnormality occurs in the image forming system 1. FIG. 4 is a flowchart illustrating a sheet conveyance operation at the time of the occurrence of abnormality in a case in which the image forming apparatus 2 stops the discharge of a sheet being printed. FIG. 4 is a flowchart in a case of the occurrence of the abnormality in the image forming apparatus 2.

If a notification of the occurrence of the abnormality in the image forming apparatus 2 is received from the image forming apparatus 2, the post processing control section 24 starts a sheet conveyance operation at the time of abnormality (START). If the notification of the occurrence of the abnormality is received, the post processing control section 24 stops all the operations in the post-processing apparatus 3 (ACT 01). The fourth detection sensor 84 detects whether or not there is a sheet that is being carried in from the image forming apparatus 2 to the post-processing apparatus 3 (ACT 02).

If there is the sheet being carried in (YES in ACT 02), the roller control section 241 determines whether or not there is an instruction relating to the post processing (ACT 03). If the sort mode or the staple mode is selected, it is determined that there is an instruction relating to the post processing. If the non-sort mode is selected, it is determined that there is no instruction relating to the post processing.

In a case in which there is an instruction relating to the post processing (YES in ACT 03), the roller control section 241 conveys the sheet in the post-processing apparatus 3 to the processing tray 51 (ACT 04). In this case, the roller control section 241 drives the inlet rollers 72*a* and 72*b* to convey the sheet being carried in by the inlet rollers 72*a* and 72*b* to the downstream side. The roller control section 241 drives the exit rollers 73*a* and 73*b* to convey the sheet in the conveyance path 71 to the downstream side. The roller control section 241 drives the inlet rollers 30*a* and 30*b* to convey the sheet to the second conveyance path 32. The roller control section 241 drives the exit rollers 34*a* and 34*b* to convey the sheet in the second conveyance path 32 to the downstream side. Further, the roller control section 241 drives the exit rollers 34*a* and 34*b* to convey the sheet being conveyed by the exit rollers 34*a* and 34*b* to the downstream side. Through these conveyance operations, the sheet being conveyed and the sheet being carried in by the post-processing apparatus 3 are conveyed to the processing tray 51.

In a case in which there is no instruction relating to the post processing (NO in ACT 03), the roller control section 241 conveys the sheet in the post-processing apparatus 3 to the fixed tray 23*a* (ACT 05). In this case, the roller control section 241 drives the inlet rollers 72*a* and 72*b* to convey the sheet being carried in by the inlet rollers 72*a* and 72*b* to the downstream side. The roller control section 241 drives the exit rollers 73*a* and 73*b* to convey the sheet in the conveyance path 71 to the downstream side. The roller control section 241 drives the inlet rollers 30*a* and 30*b* to convey the sheet to the first conveyance path 31. Further, the roller control section 241 drives the discharge rollers 33*a* and 33*b* to discharge the sheet in the first conveyance path 31 to the fixed tray 23*a*.

If the conveyance of the sheet is completed, the notification section 243 notifies the image forming apparatus 2 of the number of the sheets that are carried in by the inlet rollers 72*a* and 72*b* (ACT 06). If the notification is terminated, the roller control section 241 terminates the sheet conveyance operation at the time of the occurrence of the abnormality (END).

In a case in which there is no sheet being carried in (NO in ACT 02), the detection sensor 80 detects whether or not there is a sheet being conveyed in each conveyance path (ACT 07). The sheet being conveyed is a sheet in the post-processing apparatus 3 and a sheet in the conveyance path 71, the first conveyance path 31, the second conveyance path 32 and the standby tray 41. The sheet in the fixed tray 23*a*, the movable tray 23*b* or the processing tray 51 is not contained in the sheet being conveyed. In a case in which there is no sheet being conveyed (NO in ACT 07), the roller control section 241 determines that there is no sheet to be conveyed and terminates the sheet conveyance operation at the time of the occurrence of the abnormality (END).

In a case in which there is a sheet being conveyed (YES in ACT 07), the roller control section 241 determines whether or not there is an instruction relating to the post processing (ACT 08). In a case in which there is an instruction relating to the post processing (YES in ACT 08), the roller control section 241 conveys the sheet in the post-processing apparatus 3 to the processing tray 51 (ACT 09). The conveyance operation of the sheet shown in ACT 09 is identical to the conveyance operation of the sheet shown in ACT 04. If the conveyance of the sheet is completed, the roller control section 241 terminates the sheet conveyance operation at the time of the occurrence of abnormality.

In a case in which there is no instruction relating to the post processing (NO in ACT 08), the roller control section 241 conveys the sheet in the post-processing apparatus 3 to the fixed tray 23*a* (ACT 10). If the conveyance of the sheet is completed, the roller control section 241 terminates the sheet conveyance operation at the time of the occurrence of the abnormality. The conveyance operation of the sheet shown in ACT 10 is identical to the conveyance operation of the sheet shown in ACT 05.

Next, a sheet conveyance operation at the time of abnormality that occurs in the post-processing apparatus 3 is described. FIG. 5~FIG. 9 are flowcharts illustrating the sheet conveyance operations at the time of the occurrence of the abnormality. If it is detected that the abnormality occurs in the post-processing apparatus 3, the post processing control section 24 starts the sheet conveyance operation at the time of the occurrence of the abnormality (START). If the abnormality is detected, the post processing control section 24 stops all the operations in the post-processing apparatus 3 (ACT 21). The jam detection section 242 specifies a location where the abnormality occurs (ACT 22). The abnormality occurrence location is specified according to, for example, a driving amount and a torque of each roller for conveying a sheet and a detection result of the detection sensors 80 obtained at the time of driving the roller. The abnormality refers to, for example, a sheet jam in the conveyance path.

In a case in which the abnormality occurrence location is the punch section 70 (ACT 22), the roller control section 241 carries out a first discharge processing (ACT 30). In a case in which the abnormality occurrence location is the first conveyance path (ACT 22: the first conveyance path), the roller control section 241 carries out a second discharge processing (ACT 40). In a case in which the abnormality occurrence location is the second conveyance path (ACT 22), the roller control section 241 carries out a third discharge processing (ACT 50). In a case in which the abnormality occurrence location is the standby section 21 (ACT 22: the standby section), the roller control section 241 carries out a fourth discharge processing (ACT 60). If the discharge processing is completed, the roller control section 241 terminates the sheet conveyance operation at the time of the occurrence of the abnormality.

Figure 6:
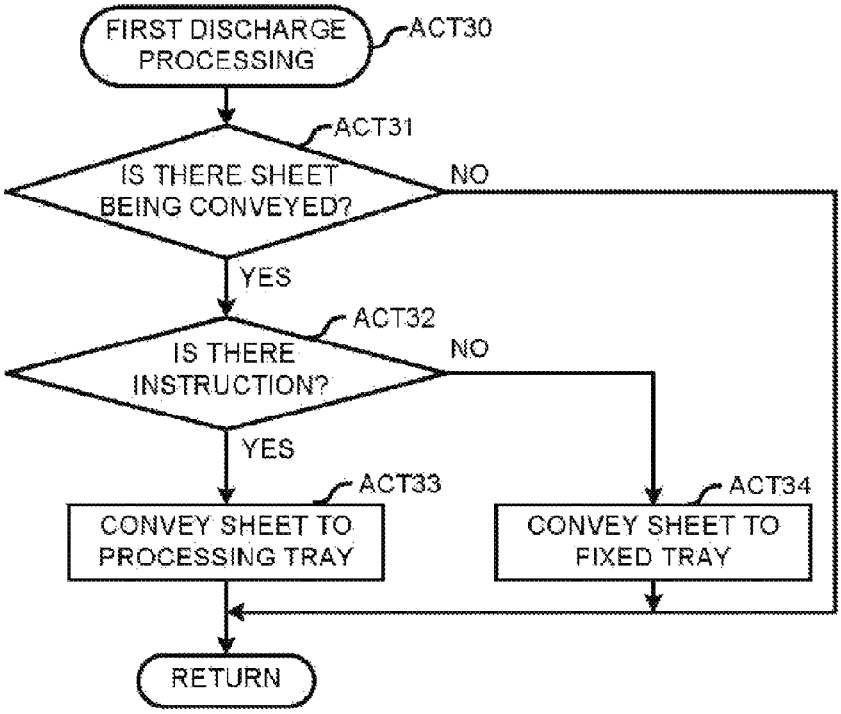
FIG. 6 is a third flowchart illustrating a sheet conveyance operation carried out by the post-processing apparatus at a time of occurrence of an abnormality.

Hereinafter, the first, the second, the third and the fourth discharge processing are respectively described. FIG. 6 is a flowchart illustrating the first discharge processing when the abnormality occurs in the punch section 70. If the first discharge processing is started, the detection sensor 80 detects whether or not there is a sheet being conveyed in each conveyance path (ACT 31). In a case in which there is no sheet being conveyed (NO in ACT 31), the roller control section 241 determines that there is no sheet to be conveyed and then terminates the first discharge processing (RETURN).

In a case in which there is a sheet being conveyed (YES in ACT 31), the roller control section 241 determines whether or not there is an instruction relating to the post processing (ACT 32). In a case in which there is an instruction relating to the post processing (YES in ACT 32), the roller control section 241 conveys the sheet in the post-processing apparatus 3 to the processing tray 51 (ACT 33). In this case, the roller control section 241 drives the inlet rollers 30*a* and 30*b* to convey the sheet to the second conveyance path. The roller control section 241 drives the exit rollers 34*a* and 34*b* to convey the sheet in the second conveyance path 32 to the downstream side. Further, the roller control section 241 drives the exit rollers 34*a* and 34*b* to convey the sheet being conveyed by the exit rollers 34*a* and 34*b* to the downstream side. Through these conveyance operations, the sheet being conveyed in the post-processing apparatus 3 is conveyed to the processing tray 51. If the conveyance of the sheet is completed, the roller control section 241 terminates the first discharge processing (RETURN).

In a case in which there is no instruction relating to the post processing (NO in ACT 32), the roller control section 241 conveys the sheet in the post-processing apparatus 3 to the fixed tray 23*a* (ACT 34). In this case, the roller control section 241 drives the inlet rollers 30*a* and 30*b* to convey the sheet to the first conveyance path 31. The roller control section 241 further drives the discharge rollers 33*a* and 33*b* to discharge the sheet in the first conveyance path 31 to the fixed tray 23*a*. Through these conveyance operations, the sheet being conveyed in the post-processing apparatus 3 is conveyed to the fixed tray 23*a*. If the conveyance of the sheet is completed, the roller control section 241 terminates the first discharge processing (RETURN).

Figure 7:
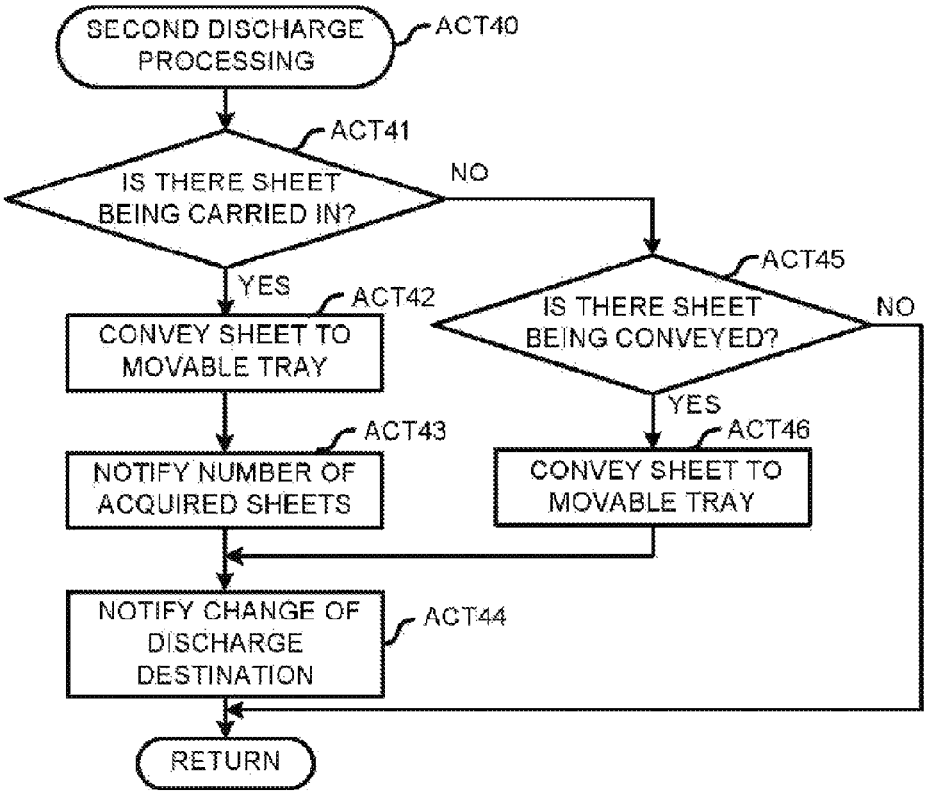
FIG. 7 is a fourth flowchart illustrating a sheet conveyance operation carried out by the post-processing apparatus at a time of occurrence of abnormality.

FIG. 7 is a flowchart illustrating the second discharge processing when the abnormality occurs in the first conveyance path 31. If the second discharge processing is started, the fourth detection sensor 84 detects whether or not there is a sheet being carried in from the image forming apparatus 2 to the post-processing apparatus 3 (ACT 41). In a case in which there is a sheet being carried in (YES in ACT 41), the roller control section 241 conveys the sheet in the post-processing apparatus 3 to the movable tray 23*b* (ACT 42). In this case, the roller control section 241 drives the inlet rollers 72*a* and 72*b* to convey the sheet being carried in by the inlet rollers 72*a* and 72*b* to the downstream side. The roller control section 241 drives the exit rollers 73*a* and 73*b* to convey the sheet in the conveyance path 71 to the downstream side. The roller control section 241 drives the inlet rollers 30*a* and 30*b* to convey the sheet to the second conveyance path 32. The roller control section 241 drives the exit rollers 34*a* and 34*b* to convey the sheet in the second conveyance path 32 to the downstream side. The roller control section 241 drives the exit rollers 34*a* and 34*b* to convey the sheet being conveyed by the exit rollers 34*a* and 34*b* to the downstream side. Further, the roller control section 241 drives the discharge roller 59*a* to discharge the sheets in the standby section 21 and the processing section 22 to the movable tray 23*b*. Through these conveyance operations, the sheet being conveyed in the post-processing apparatus 3 and the sheet being carried in are conveyed to the movable tray 23*b*.

If the conveyance of the sheet is completed, the notification section 243 notifies the image forming apparatus 2 of the number of the sheets being carried in by the inlet rollers 72*a* and 72*b* (ACT 43). Further, the notification section 243 notifies the image forming apparatus 2 that the discharge destination of the sheet is changed from the fixed tray 23*a* to the movable tray 23*b* (ACT 44). If the notification is terminated, the roller control section 241 terminates the second discharge processing (RETURN).

In a case in which there is no sheet being carried in (NO in ACT 41), the fourth detection sensor 84 detects whether or not there is a sheet being conveyed in the conveyance path 71 of the punch section 70 (ACT 45). In a case in which there is no sheet being conveyed (NO in ACT 45), the roller control section 241 determines that there is no sheet to be conveyed and then terminates the second discharge processing (RETURN).

In a case in which there is a sheet being conveyed (YES in ACT 45), the roller control section 241 makes the sheet in the post-processing apparatus 3 conveyed to the movable tray 23*b* (ACT 46). The conveyance operation of the sheet shown in ACT 46 is identical to the conveyance operation of the sheet shown in ACT 42. If the conveyance of the sheet is completed, the notification section 243 notifies the image forming apparatus 2 of the change of the discharge destination from the fixed tray 23*a* to the movable tray 23*b* (ACT 44). If the notification is terminated, the roller control section 241 terminates the second discharge processing (RETURN).

Figure 8:
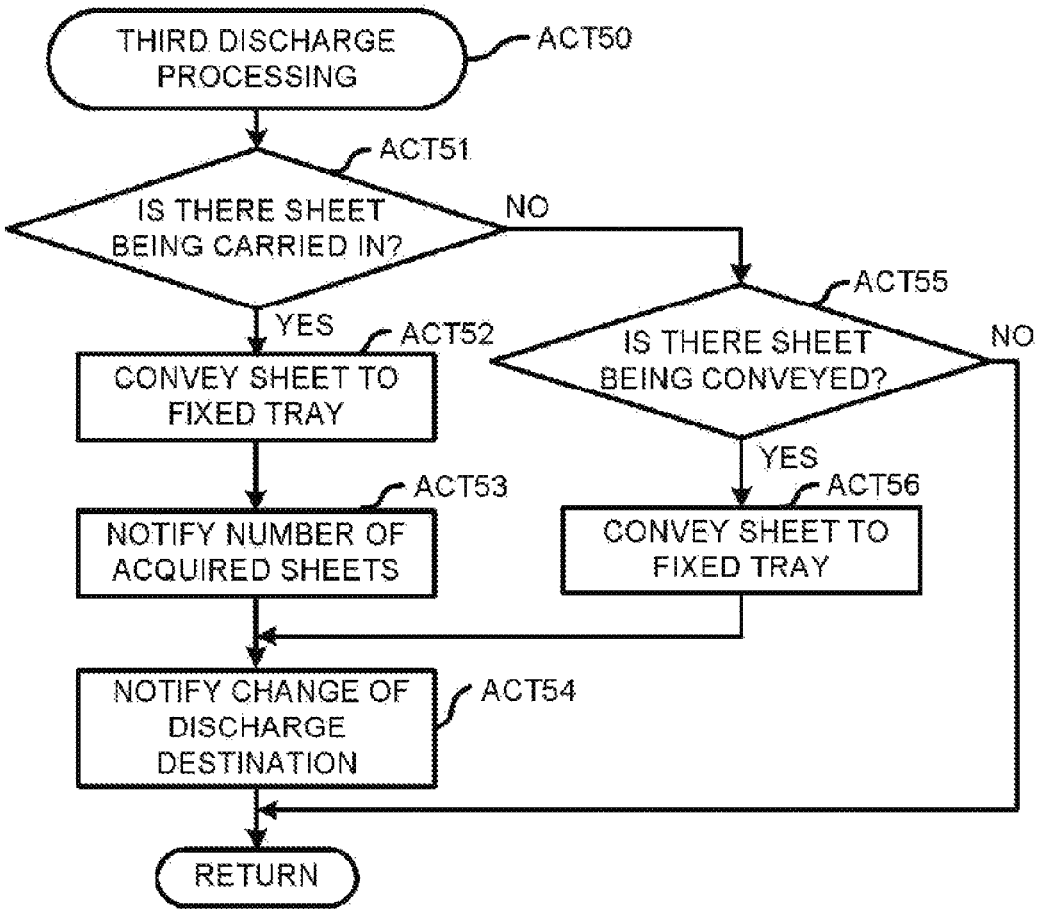
FIG. 8 is a fifth flowchart illustrating a sheet conveyance operation carried out by the post-processing apparatus at a time of occurrence of an abnormality.

FIG. 8 is a flowchart illustrating the third discharge processing when the abnormality occurs in the second conveyance path 32. If the third discharge processing is started, the fourth detection sensor 84 detects whether or not there is a sheet being carried in from the image forming apparatus 2 to the post-processing apparatus 3 (ACT 51). In a case in which there is a sheet being carried in (YES in ACT 51), the roller control section 241 makes the sheet in the post-processing apparatus 3 conveyed to the fixed tray 23*a* (ACT 52). In this case, the roller control section 241 drives the inlet rollers 72*a* and 72*b* to convey the sheet being carried in by the inlet rollers 72*a* and 72*b* to the downstream side. The roller control section 241 drives the exit rollers 73*a* and 73*b* to convey the sheet in the conveyance path 71 to the downstream side. The roller control section 241 drives the inlet rollers 30*a* and 30*b* to convey the sheet to the first conveyance path 31. Further, the roller control section 241 drives the discharge rollers 33*a* and 33*b* to discharge the sheet in the first conveyance path 31 to the fixed tray 23*a*. Through these conveyance operations, the sheet being conveyed in the post-processing apparatus 3 is conveyed to the fixed tray 23*a*.

If the conveyance of the sheet is completed, the notification section 243 notifies the image forming apparatus 2 of the number of the sheets being carried in by the inlet rollers 72*a* and 72*b* (ACT 53). Further, the notification section 243 notifies the image forming apparatus 2 of the change of the discharge destination of the sheet from the processing tray 51 to the fixed tray 23*a* (ACT 54). If the notification is terminated, the roller control section 241 terminates the third discharge processing (RETURN).

In a case in which there is no sheet being carried in (NO in ACT 51), the fourth detection sensor 84 detects whether or not there is a sheet being conveyed in the conveyance path 71 of the punch section 70 (ACT 55). In a case in which there is no sheet being conveyed (NO in ACT 55), the roller control section 241 determines that there is no sheet to be conveyed and then terminates the third discharge processing (RETURN).

In a case in which there is a sheet being conveyed (YES in ACT 55), the roller control section 241 conveys the sheet in the post-processing apparatus 3 to the fixed tray 23*a* (ACT 56). The conveyance operation of the sheet shown in ACT 56 is identical to the conveyance operation of the sheet shown in ACT 52. If the conveyance of the sheet is completed, the notification section 243 notifies the image forming apparatus 2 of the change of the discharge destination from the processing tray 51 to the fixed tray 23*a* (ACT 54). If the notification is terminated, the roller control section 241 terminates the third discharge processing (RETURN).

Figure 9:
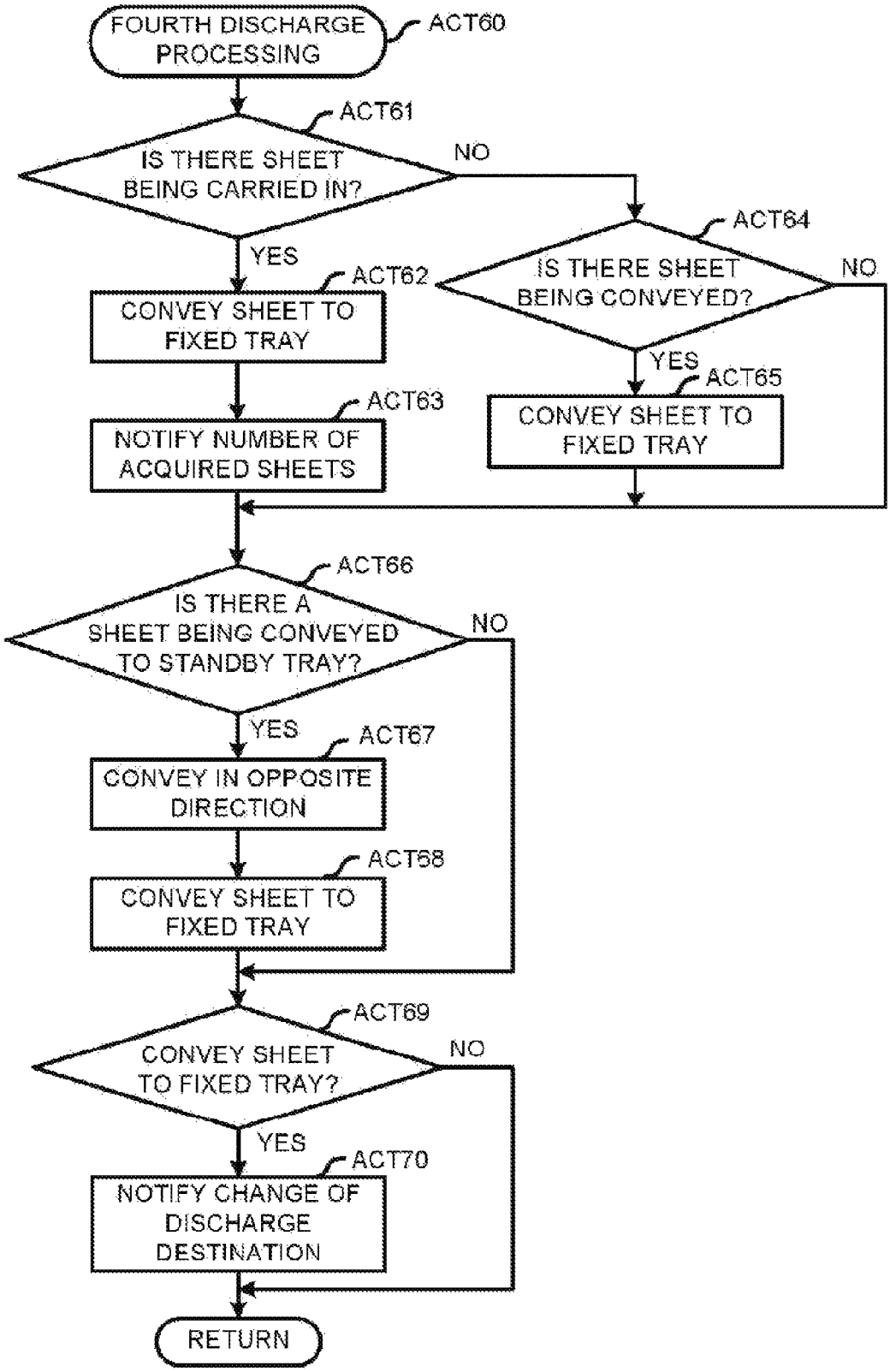
FIG. 9 is a sixth flowchart illustrating a sheet conveyance operation carried out by the post-processing apparatus at a time of occurrence of an abnormality.

FIG. 9 is a flowchart illustrating the fourth discharge processing when the abnormality occurs in the standby section 21. If the fourth discharge processing is started, the fourth detection sensor 84 detects whether or not there is a sheet being carried in from the image forming apparatus 2 to the post-processing apparatus 3 (ACT 61). In a case in which there is a sheet being carried in (YES in ACT 61), the roller control section 241 conveys the sheet in the post-processing apparatus 3 to the fixed tray 23*a* (ACT 62). The conveyance operation of the sheet shown in ACT 62 is identical to the conveyance operation of the sheet shown in ACT 52.

Through these conveyance operations, the sheet being carried in, the sheet in the punch section 70 and the sheet being conveyed by the inlet rollers 30*a* and 30*b* are conveyed to the fixed tray 23*a*. If the conveyance of the sheet is completed, the notification section 243 notifies the image forming apparatus 2 of the number of the sheets being carried in by the inlet rollers 72*a* and 72*b* (ACT 63). If the notification is completed, the roller control section 241 proceeds to the processing in ACT 66.

In a case in which there is no sheet being carried in (NO in ACT 61), the fourth detection sensor 84 detects whether or not there is a sheet being conveyed in the conveyance path 71 of the punch section 70 (ACT 64). In a case in which there is no sheet being conveyed (NO in ACT 64), the roller control section 241 proceeds to the processing in ACT 66. In a case in which there is a sheet being conveyed (YES in ACT 64), the roller control section 241 makes the sheet in the post-processing apparatus 3 conveyed to the fixed tray 23*a* (ACT 65). The conveyance operation of the sheet shown in ACT 65 is identical to the conveyance operation of the sheet shown in ACT 52. Through these conveyance operations, the sheet in the punch section 70 and the sheet being conveyed by the inlet rollers 30*a* and 30*b* are conveyed to the fixed tray 23*a*.

The third detection sensor 83 detects whether or not there is a sheet being conveyed to the standby tray 41 (ACT 66). In a case in which there is a sheet being conveyed (YES in ACT 66), the roller control section 241 drives each roller in an opposite direction to convey the sheet that is being conveyed to the upstream side (ACT 67). In ACT 67, the rollers driven in an opposite direction include the exit rollers 34*a* and 34*b*, the inlet rollers 30*a* and 30*b* and the exit rollers 73*a* and 73*b*. Through the conveyance shown in ACT 67, the sheet being conveyed to the standby tray 41 is conveyed to punch section 70 via the second conveyance path 32.

If the sheet being conveyed returns to the punch section 70, the roller control section 241 conveys the corresponding sheet to the fixed tray 23*a* (ACT 68). The conveyance operation of the sheet shown in ACT 68 is identical to the conveyance operation of the sheet shown in ACT 52. Through these conveyance operations, the sheet in the punch section 70 is conveyed to the fixed tray 23*a*.

The notification section 243 determines whether or not the sheet is conveyed to the fixed tray 23*a* in the fourth discharge processing (ACT 69). In a case in which the sheet is conveyed (YES in ACT 69), the notification section 243 notifies the image forming apparatus 2 of the change of the discharge destination of the sheet (ACT 70). The notification in this case refers to the change of the discharge destination from the processing tray 51 to the fixed tray 23*a*. If the notification is terminated, the roller control section 241 terminates the fourth discharge processing (RETURN). In a case in which the sheet is not conveyed (NO in ACT 69), the roller control section 241 terminates the fourth discharge processing (RETURN).

Through the execution of the sheet conveyance operation at the time of the occurrence of the abnormality by the post-processing apparatus 3 of the embodiment, the sheet being conveyed in the post-processing apparatus 3 can be conveyed to a designated tray. Through the conveyance, it takes less time for the user to remove the sheet being conveyed in the post-processing apparatus 3 at the time of recovery from the abnormality of the sheet jam, thereby improving the convenience. Further, as the number of the sheets to be removed is reduced, the time spent on the recovery is shortened. The sheets during the removing process can be prevented from being damaged by reducing an amount of the sheets removed by the user.

If the image forming apparatus 2 or the post-processing apparatus 3 stops the operation due to the occurrence of the abnormality, then the sheet that is being carried in into the post-processing apparatus 3 is stopped. In a case in which the sheet that is being carried in is conveyed to a tray, the image forming apparatus 2 cannot detect that the sheet is carried out to the post-processing apparatus 3. In the present embodiment, the notification section 243 notifies the image forming apparatus 2 of the number of the sheets that are being carried in. According to the notification, the image forming apparatus 2 can understand the number of the sheets carried out to the post-processing apparatus 3. When recovering from the abnormality, the image forming apparatus 2 can continue discharging the sheet without generating repeat or damage. Further, in a case in which there is a sheet discharged to the fixed tray 23*a* in the staple mode, the sheet is discharged but not stapled to prevent the damage to the sheet.

In a case in which the post-processing apparatus 3 changes the discharge destination of the sheet, this change is notified to the image forming apparatus 2 by the notification section 243 and thus notified to the user. The user can understand that the sheet is discharged to a tray other than the designated tray according to this notification.

According to the embodiment, in a case in which the non-sort mode is selected, it is described that the roller control section 241 conveys the sheet being conveyed to the fixed tray 23*a*. However, in the non-sort mode, in a case in which the movable tray 23*b* is selected as the discharge destination, the roller control section 241 may convey the sheet to the movable tray 23*b*.

In a case in which the abnormality exists in the post-processing apparatus 3, the bunch pawl drive mechanism and the discharge rollers 59*a* and 59*b* serving as discharge sections may discharge the sheet on the processing tray 51. The discharge destination of the sheet in this case becomes the movable tray 23*b*. A possibility that the abnormality occurs again can be reduced by decreasing the sheets remaining in the post-processing apparatus 3 at the time of the recovery from the former abnormality.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A post-processing apparatus, comprising:

a processing section configured to execute a post processing on a sheet;

a first tray configured to receive a sheet on which the post processing is not executed by the processing section;

a second tray configured to temporarily place a sheet in the post-processing apparatus;

an inlet roller configured to carry in a sheet discharged from an image forming apparatus into the post-processing apparatus;

a first roller configured to convey the sheet carried in by the inlet roller to the first tray;

a second roller configured to convey the sheet carried in by the inlet roller to the second tray;

a detection sensor configured to detect whether or not there is a sheet being conveyed in a sheet conveyance path from the inlet roller to the first or the second tray;

a punch section configured to be arranged between the inlet roller and the first roller and the second roller;

a roller control section configured to drive the first roller or the second roller in a case in which the image forming apparatus stops the discharge of the sheet that is being printed and the detection sensor detects the sheet; and a jam detection section configured to detect a sheet jam in the post-processing apparatus, wherein the roller control section drives the second roller in an opposite direction in a case in which there is the sheet jam in the post-processing apparatus and there is no sheet in the punch section.

2. The post-processing apparatus according to claim 1, wherein:

the roller control section drives the first roller to convey a sheet that is being conveyed to the second tray to the first tray in a case in which there is the sheet jam; and the roller control section drives the first roller or the second roller corresponding to a tray designated by a user in a case in which there is no sheet jam.

3. The post-processing apparatus according to claim 2, wherein:

the punch section is configured to punch a hole on the sheet carried in by the inlet roller, wherein the detection sensor detects whether or not there is a sheet in the punch section; and the roller control section drives the first roller in a case in which there is the sheet jam in the post-processing apparatus and there is the sheet in the punch section.

4. The post-processing apparatus according to claim 3, wherein the roller control section, after driving the second roller in an opposite direction, drives the first roller in a case in which the sheet is detected by the punch section.

5. The post-processing apparatus according to claim 2, further comprising:

a third tray arranged on the side surface of the post-processing apparatus; and a discharge section configured to convey the sheet on the second tray to the third tray, wherein in a case in which there is the sheet jam in the post-processing apparatus and there is a sheet on the second tray, the discharge section conveys the sheet on the second tray to the third tray.

6. The post-processing apparatus according to claim 2, wherein the detection sensor comprises a first detection sensor, a second detection sensor and a third detection sensor;

the first detection sensor is arranged in the sheet conveyance path from the inlet roller to the first roller;

the second detection sensor is arranged in the sheet conveyance path from the inlet roller to the second roller;

the third detection sensor is arranged in the sheet conveyance path from the second roller to the second tray; and the jam detection section detects the sheet jam according to a driving amount of the inlet roller, the first and the second trays and detection results of the first, the second and the third detection sensors.

7. The post-processing apparatus according to claim 2, further comprising:

a notification section configured to notify the image forming apparatus that a sheet is discharged to a tray different from the tray designated by the user after the image forming apparatus stops the discharge of the sheet that is being printed.

8. The post-processing apparatus according to claim 1, wherein the roller control section drives the inlet roller to carry in the sheet that is being carried in into the post-processing apparatus at the time the image forming apparatus stops the discharge of the sheet that is being printed; and the roller control section drives the first or the second roller to convey the sheet that is being carried-in to the first or the second tray.

9. An image forming system, comprising:

an image forming apparatus that discharges a sheet on which an image is formed and a post-processing apparatus mounted integrally with the image forming apparatus, wherein the post-processing apparatus comprises:

a processing section configured to execute a post processing on a sheet;

a first tray configured to receive a sheet on which the post processing is not executed by the processing section;

a second tray configured to temporarily place a sheet in the post-processing apparatus;

an inlet roller configured to carry in a sheet discharged from an image forming apparatus into the post-processing apparatus;

a first roller configured to convey the sheet carried in by the inlet roller to the first tray;

a second roller configured to convey the sheet carried in by the inlet roller to the second tray;

a detection sensor configured to detect whether or not there is sheet being conveyed in a sheet conveyance path from the inlet roller to the first or the second tray;

a roller control section configured to drive the first or the second roller in a case in which the image forming apparatus stops the discharge of the sheet that is being printed and the detection sensor detects the sheet; and a notification section configured to notify the image forming apparatus of the number of the sheets carried into the post-processing apparatus after the image forming apparatus stops the discharge of the sheet that is being printed; and the image forming apparatus determines a page at the time of restart of a printing processing on the basis of the number of the sheets already discharged to the post-processing apparatus and the number of the sheets notified by the notification section.

* * * * *